US010038244B2

(12) United States Patent
Collignon

(10) Patent No.: US 10,038,244 B2
(45) Date of Patent: Jul. 31, 2018

(54) FLAT ANTENNA FOR SATELLITE COMMUNICATION

(71) Applicant: INEO DEFENSE, Velizy-Villacoublay (FR)

(72) Inventor: Gérard Collignon, Orsay (FR)

(73) Assignee: INEO DEFENSE, Velizy-Villacoublay (FR)

( * ) Notice: Subject to any disclaimer, the term of this patent is extended or adjusted under 35 U.S.C. 154(b) by 59 days.

(21) Appl. No.: 15/314,086

(22) PCT Filed: Jun. 8, 2015

(86) PCT No.: PCT/EP2015/062683

§ 371 (c)(1),
(2) Date: Nov. 27, 2016

(87) PCT Pub. No.: WO2015/189136

PCT Pub. Date: Dec. 17, 2015

(65) Prior Publication Data

US 2017/0187115 A1 Jun. 29, 2017

(30) Foreign Application Priority Data

Jun. 13, 2014 (FR) ..... 14 55393

(51) Int. Cl.

| | |
|---|---|
| ***H01Q 9/04*** | (2006.01) |
| ***H01Q 1/28*** | (2006.01) |
| ***H01Q 15/14*** | (2006.01) |

(52) U.S. Cl.
CPC ..... *H01Q 9/0407* (2013.01); *H01Q 1/288* (2013.01); *H01Q 15/14* (2013.01)

(58) Field of Classification Search
CPC ..... H01Q 9/0407; H01Q 1/288; H01Q 15/14
See application file for complete search history.

(56) References Cited

U.S. PATENT DOCUMENTS

| | | | |
|---|---|---|---|
| 2,566,703 | A | 9/1951 | Iams |
| 3,170,158 | A | 2/1965 | Rotman |
| 8,284,102 | B2 | 10/2012 | Hayes et al. |

FOREIGN PATENT DOCUMENTS

| | | | |
|---|---|---|---|
| GB | 2 184 607 | A | 6/1987 |
| GB | 2 398 172 | A | 8/2004 |
| WO | 00/22696 | A1 | 4/2000 |

*Primary Examiner* — Graham Smith

(74) *Attorney, Agent, or Firm* — Im IP Law; C. Andrew Im

(57) ABSTRACT

A flat antenna for satellite communication includes a radiating board. The radiating board includes at least one radiating line, and an adapter configured to modify the delay of the fields transmitted or received by the radiating line. The adapter includes a horn mobile in rotation between the two metal plates, and a multilayer power supply circuit. The first layer of the multilayer power supply circuit is formed at least one metal plate containing an array of slot sensors and the last layer of the multilayer power supply circuit is provided with at least one coupling slot connected to the radiating line. The first layer and the last layer is linked by at least one transmission line. The length of the transmission line is suitable for introducing a delay required to focus the wave radiated by the radiating line.

12 Claims, 5 Drawing Sheets

FLAT ANTENNA FOR SATELLITE COMMUNICATION

RELATED APPLICATIONS

This application is a § 371 application from PCT/EP2015/062683 filed Jun. 8, 2015, which claims priority from French Patent Application No. 14 55393 filed Jun. 13, 2014, each of which is incorporated herein by reference in its entirety.

FIELD OF THE INVENTION

The present invention pertains to the field of flat antennas for satellite telecommunications. The invention is particularly adapted for aircraft.

The invention finds a particularly advantageous application for sending and receiving data to or from a satellite in particular for satellite telecommunications of Satcom type (acronym of "Satellite communication").

BACKGROUND OF THE INVENTION

For certain telecommunications applications, in particular airborne applications, it is necessary to use flat antennas of very small thickness so as not to modify the aerodynamic profile of the carrier, for example when the antenna is positioned on the surface of an aircraft.

These telecommunication antennas comprise a plane surface comprising at least one radiating line able to transmit and receive signals of a frequency determined as a function of the shape of the radiating line. The signals are sent and received in the direction of the satellite which may be skewed with respect to the normal direction of the antenna as a function of the movements of the carrier. More specifically, these antennas must point a very directional beam inside a cone with a half-angle of at least 60° so that the antenna gain remains sufficient to guarantee the signal-to-noise ratio necessary for the quality of the link.

A known solution for carrying out this pointing consists in using a flat antenna 100 such as described in FIG. 1. This flat antenna 100 extends in a plane xy on an external wall 101 of an aircraft. Radiating lines 102 of the flat antenna 100 send and receive signals in a direction 103 skewed by an angle $\alpha$ with respect to the direction z normal to the surface of the flat antenna 100 in the plane perpendicular to the radiating lines 102 (xoz). This skewing requires an adjustment of the phase on each radiating line by means for example of programmable electronic phase shifters. The phase $\varphi_i$; to be displayed on line i so as to obtain a pointing in the direction $\alpha$ is given by the expression:

$$\varphi_i = 2\pi i\, d \sin \alpha / \lambda;$$

with: i corresponding to the index of the line, d to the spacing between the lines and $\lambda$ to the wavelength.

In order to skew the signals received in a cone, the flat antenna 100 is moreover movable in rotation $\beta$ about an axis z orthonormal with the axes xy.

This first solution makes it possible to electronically scan all the pointing directions inside the cone.

However, the direction of the pointing in terms of $\alpha$ varies with the wavelength $\lambda$ and does not allow simultaneous operation in two very different frequency bands such as in the Satcom Ka band for example (20 GHz when receiving, 30 GHz when sending).

To remedy this problem, it is known to use a ROTMAN lens described, for example, in U.S. Pat. No. 3,170,158. The ROTMAN lens is a known device making it possible customarily to obtain an antenna that radiates several beams that are skewed in a plane. The lens is furnished with N accessways each giving a beam in a frequency-independent given direction. Angular scanning is obtained by switching between the N available beams.

The lens is formed by the space between two parallel conducting planes, the input array consists of fixed horns embodied in waveguide form and radiating a polarization perpendicular to the metallic planes. The output array can consist of monopole type elements perpendicular to the metallic planes and making it possible to tap off the energy radiated by the horns of the input array. The linear array of radiating elements is fed by way of links (coaxial for example) whose lengths are such that the radiated wave is plane.

According to a similar principle, U.S. Pat. No. 8,284,102, discloses an electronic phase shifter comprising an electronic selector for a linear or curved array of sources. The focusing of the antenna is carried out by internal reflector elements and means of dielectric or refractive focusing.

This second solution makes it possible to have a fixed flat antenna on the surface of an aircraft. However, this solution limits the number of directions in which the antenna can be pointed as a function of the number of linear sources. Moreover, the installation of a linear array of sources and means of electronic selection increases the bulkiness of the flat antenna.

Furthermore, the ROTMAN lens is conventionally hooked up by coaxial cables connected between the ROTMAN lens and the radiating lines of the antenna. The length of the coaxial cables is adapted so as to introduce a delay required for focusing the wave radiated by the radiating lines for each horn of the ROTMAN lens. These cables are, of course, equipped with connectors at each end.

Such an antenna poses production problems when the antenna is designed to operate in the Ku or Ka high-frequency bands. Firstly, the length of the cables must be extremely precise so as to limit the errors in the phase. For example, for an antenna operating at 30 GHz, an error of 0.2 mm in the length of a coaxial cable induces a phase error of about 10°. Secondly, the size of the connectors of the coaxial cables limits the possibilities of installation and the number of usable horns. For example, for an antenna operating at 30 GHz, the spacing of the radiating lines and of the outputs of the Rotman lens is around 5 mm. Moreover, an antenna with a diameter of 500 mm operating at 30 GHz comprises about 100 cables, all different, this impacting negatively on the specifications and the steps of production.

OBJECT AND SUMMARY OF THE INVENTION

The present invention intends to remedy the drawbacks of the prior art by proposing a fixed flat antenna furnished with a horn that is movable so as to scan a large number of antenna pointing directions. The connections between the horn and the radiating board are produced by a multilayer power feed circuit.

For this purpose, the present invention relates to a flat antenna for satellite telecommunication comprising a radiating board comprising at least one radiating line, and an adaptation means able to modify the delay of the fields emitted or received by the at least one radiating line, said an adaptation means comprising a horn movable in rotation between the two metallic plates, and a multilayer power feed circuit, a first layer of which is formed by the at least one metallic plate containing an array of sensors of slot type and a last layer of which is furnished with at least one coupling slot connected to the at least one radiating line, the first layer and the last layer being linked by at least one transmission line, the length of the at least one transmission line being adapted so as to introduce a delay required for focusing the wave radiated by the radiating line.

Thus, the invention makes it possible, by displacing the rotationally movable horn, to scan a large number of pointing directions associated with the radiating lines of the antenna. The tuning of each radiating line being performed through the length of a transmission line linking the array of sensors of the at least one metallic plate and the radiating board. The invention makes it possible to fix the antenna on a plane surface, thus limiting the fragility of the antenna and improving the aerodynamic shape of the carrier of the antenna. The antenna in accordance with the invention also eliminates the need for coaxial cables and for connectors. This antenna structure operates in a very broad frequency band since the horn allows frequency-independent pointing.

According to one embodiment, the horn is able to transmit between the metallic plates a wave whose electric field is perpendicular to the metallic plates.

According to one embodiment, the length of the at least one transmission line is adapted so as to introduce an additional delay making it possible to obtain an initial fixed pointing in such a way that the total pointing varies from 0° to 60° for a symmetric displacement of the horn of about ±30°. This embodiment, associated with the 360° global rotation of the antenna about its axis z, makes it possible to contain all the directions in a cone of half-angle 60° centered on the direction normal to the antenna.

According to one embodiment, the power feed circuit consists of five metallic circuit layers separated by four dielectric layers. This embodiment is particularly adapted for an antenna of Satcom type (acronym of "Satellite communication").

According to one embodiment, the power feed circuit is assembled adhesively. This embodiment limits the complexity of the operations for assembling the multilayer power feed circuit.

According to one embodiment, two layers of the power feed circuit are linked by at least one metallized hole passing through a conducting layer contactlessly through a non-metallized wafer. This embodiment is particularly adapted for an antenna of Satcom type (acronym of "Satellite communication").

According to one embodiment, the two metallic plates containing the array of sensors of slot type are fixed on a plane parallel to the plane of said radiating board.

According to one embodiment, said radiating board comprises several radiating lines spaced apart by half a wavelength. This embodiment makes it possible in particular to avoid problems related to array lobes.

According to one embodiment, said radiating board comprises several radiating lines consisting of an alignment of radiating elements such as dipoles, patches or slots.

According to one embodiment, said radiating board comprises several radiating lines each comprising a distributor with one input and several outputs corresponding to the number of radiating elements of the radiating line.

BRIEF DESCRIPTION OF THE DRAWINGS

The invention will be better understood with the aid of the description, given hereinafter purely by way of explanation, of the embodiments of the invention, with reference to the figures in which.

DETAILED DESCRIPTION OF THE EMBODIMENTS OF THE INVENTION

Figure 1:
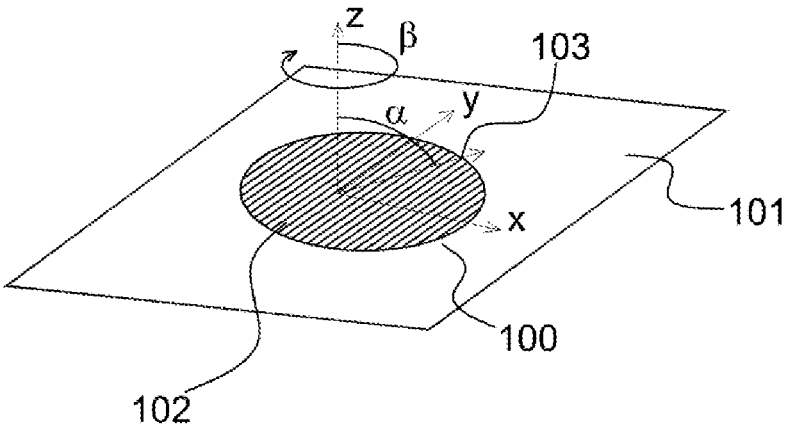
Prior Art Fig.1
FIG. 1 illustrates a flat and movable satellite telecommunications antenna according to the prior art.
Figure 2:
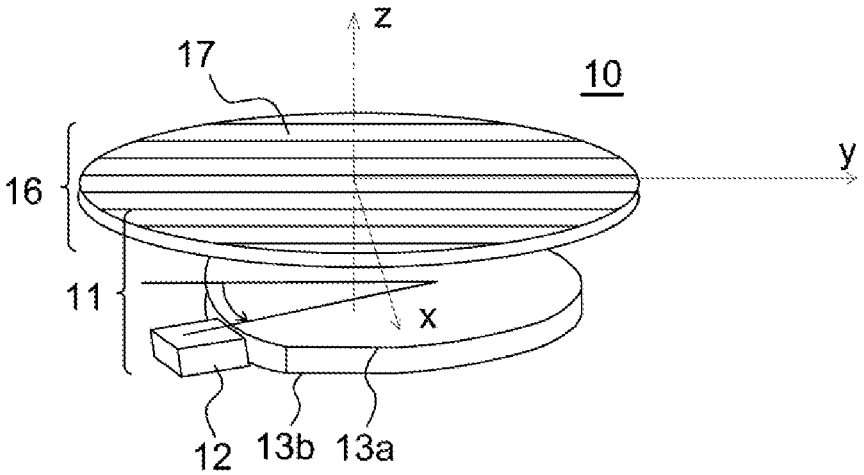
FIG. 2 illustrates a flat satellite telecommunications antenna partially represented according to an embodiment of the invention.

FIG. 2 reveals a flat satellite telecommunications antenna 10 consisting of a radiating board 16 linked to an adaptation means 11 able to modify the delays of the fields emitted or received by the radiating board 16.

The radiating board 16 extends in a plane xy and comprises several radiating lines 17 disposed along the axis y at a spacing of about half a wavelength along the axis x. Each radiating line 17 consists of an alignment of N radiating elements (not represented), for example dipoles, patches or slots disposed at a spacing of less than a wavelength along the y axis and fed by a distributor comprising one input and N outputs.

Figure 3:
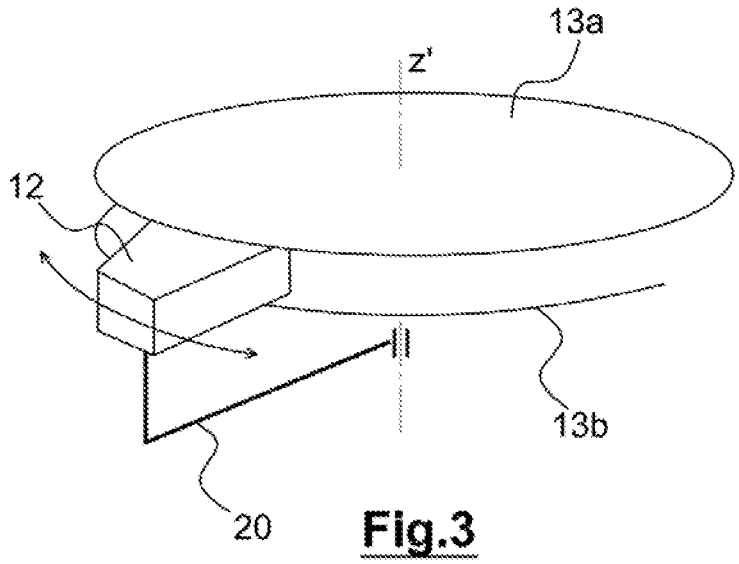
FIG. 3 illustrates the movable horn of the antenna of FIG. 2.

The adaptation means 11 consists of a horn 12 movable in rotation between two metallic plates 13*a* and 13*b* parallel to the radiating board 16. The horn 12, represented in FIG. 3, is movable in rotation about the axis z' (parallel to or coincident with the axis z) extending in a direction normal to the plane xy. The mobility of the horn 12 is ensured by a numerically controlled guide 20.

Figure 4:
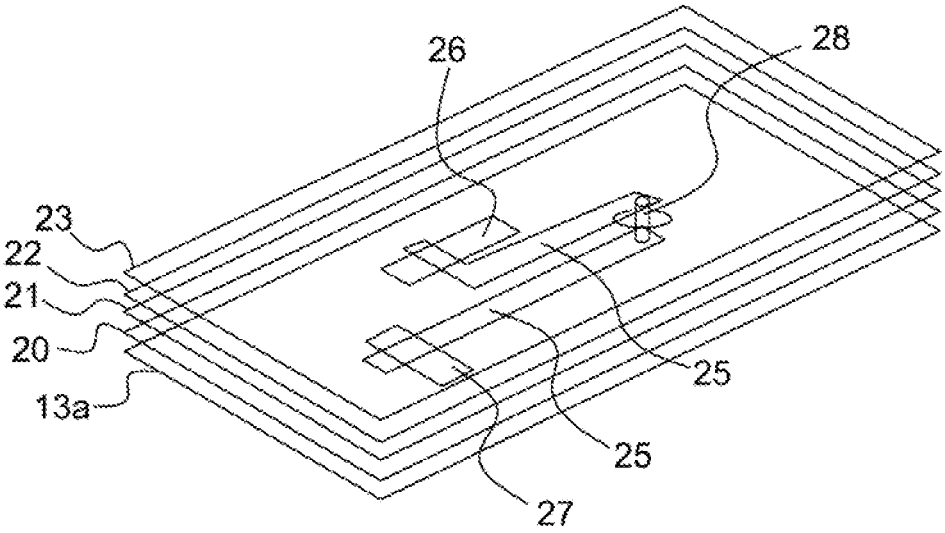
FIG. 4 illustrates the multilayer power feed circuit of the antenna of FIG. 2.

The horn 12 radiates between the two metallic plates 13*a*, 13*b* a TEM (for transverse electric-magnetic) wave whose electric field is perpendicular to the metallic plates 13*a*, 13*b*. The adaptation means 11 also comprises a multilayer power feed circuit 14, represented in FIG. 4, linking the horn 12 to the radiating board 16. This power feed circuit 14 consists of five layers of copper circuit 13*a*, 20-23, separated by four dielectric layers. The assembly is bonded together adhesively. The first layer 13*a* is formed by the upper metallic plate 13*a*. A coupling slot 27 made in this layer 13*a* gives one of the sensors of the array of sensors.

The layers 13*a*, 20 and 21 form a transmission line of triplate type whose conducting line is situated on the layer 20 and whose ground planes are situated on the layers 13*a* and 21.

The layers 21, 22 and 23 form a second transmission line of triplate type whose conducting line is situated on the layer 22 and whose ground planes are situated on the layers 21 and 23

A through passage 28 making it possible to connect the lines 25 of the layers 20 and 22 is made by means of a metallized hole passing through the conducting layer 21 contactlessly through a non-metallized resist or wafer. The layer 23 is furnished with a coupling slot 26 making it possible to feed a line 17 of the radiating board 16.

This structure makes it possible to obtain a coefficient of transmission between the coupling slot 27 and the radiating board 16 with a modulus substantially equal to one and with a delay that can be easily controlled by tailoring the length of the lines 25 of the layers 20 and 22. These lines also induce an additional delay making it possible to obtain an initial fixed pointing in such a way that the total pointing varies from 0° to 60° for a symmetric displacement of the horn 12 of about ±30°.

Figure 5:
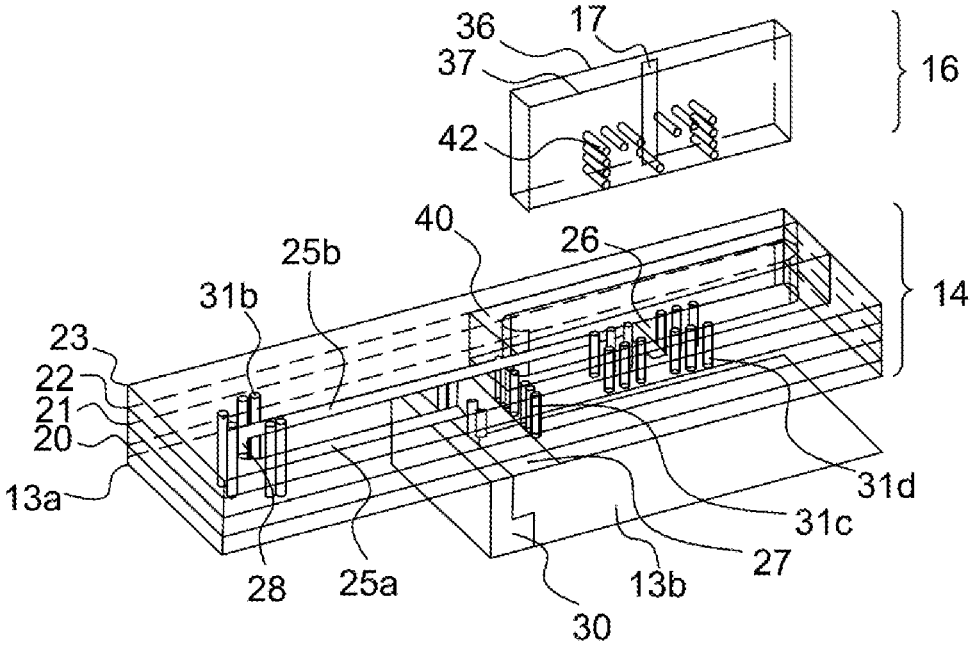
FIG. 5 illustrates a pathway of the multilayer power feed circuit according to an embodiment in a perspective view.
Figure 6:
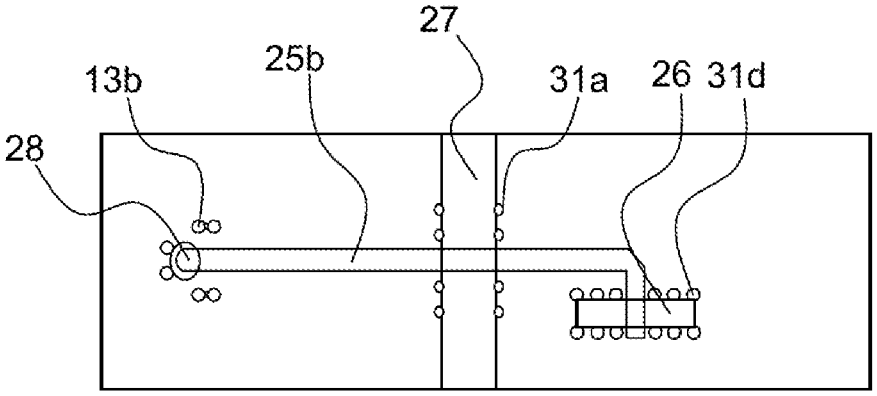
FIG. 6 illustrates the pathway of FIG. 5 in a sectional view.

FIGS. 5 and 6 represent an exemplary embodiment of the adaptation means 11 for a pathway. The adaptation means 11 consists of the metallic plates 13*a*, 13*b* disposed around the horn 12 (not represented). The propagation of the waves emitted and received by the horn 12 are transmitted to the multilayer power feed circuit 14 by a coupling slot 27. The propagation is closed between the metallic plates 13*a* and 13*b* at the rear of the slot 27 by a metallic piece 30 whose profile allows adaptation of the transmission.

The power feed circuit 14 consists of four printed-circuit layers assembled adhesively. The material used may be for example Rogers RT/duroid 5880 with a thickness of 0.508 mm.

The layers 13*a* and 21 are connected in the vicinity of the slot 27 by metallized holes making it possible to avoid the propagation of undesirable modes in the circuit. The energy tapped off by the slot 27 travels down the line 25*a* and then down the line 25*b* after a change of layer effected by means of the through passage 28. The layers 13*a*, 21 and 23 are connected in the vicinity of the through passage by metallized holes making it possible to avoid the propagation of undesirable modes in the circuit. The through passage is embodied as a metallized hole linking the layers 20 and 22. It passes through the layer 21 contactlessly through a non-metallized wafer.

The coupling at the input of a line of the radiating board 16 is effected by the slot 26. The layers 21 and 23 are connected in the vicinity of the slot 26 by metallized holes making it possible to avoid the propagation of undesirable modes in the circuit.

The input of the line of the radiating board 16 is also effected by triplate technology between the radiating line 17 and the ground planes 36 and 37. It is embedded in a metallic piece 40 ensuring precise positioning and low impedances between the various metallic layers 23, 36 and 37. The coupling between the radiating line 17 and the line 25*b* is obtained by virtue of the slot 26 and of the connection of the radiating line 17 to the ground plane 37 through the metallized hole 41. The layers 36 and 37 are connected by metallized holes 42 making it possible to avoid the propagation of undesirable modes in the circuit.

Figure 7:
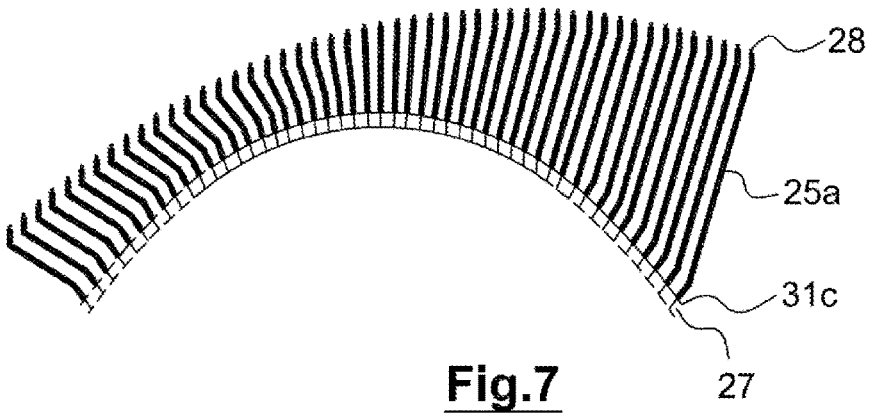
FIG. 7 illustrates the first layer of transmission lines of the multilayer power feed circuit for an exemplary antenna comprising 49 radiating lines.
Figure 8:
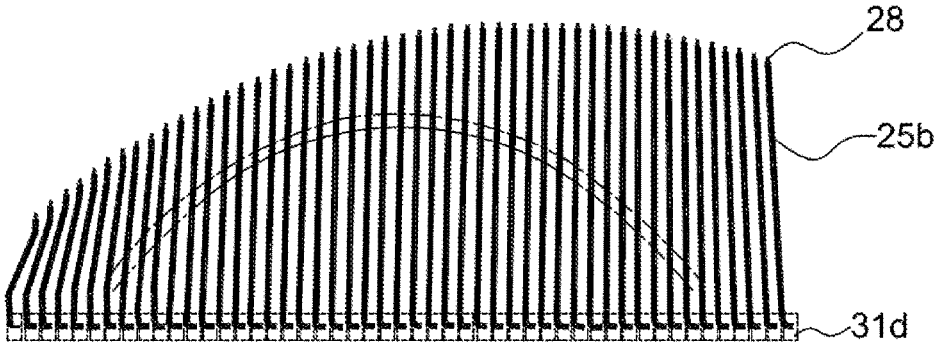
FIG. 8 illustrates the second layer of transmission lines of the multilayer power feed circuit for the example of FIG. 7.
Figure 9:
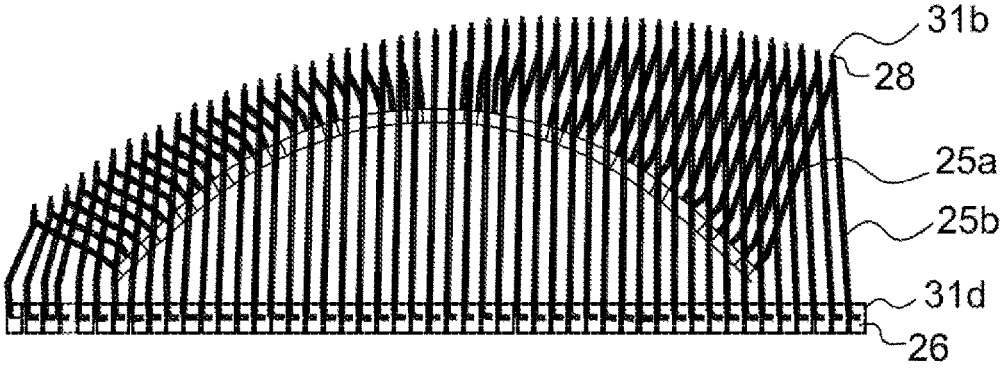
FIG. 9 illustrates the first and the second layer of transmission lines of the multilayer power feed circuit for the example of FIG. 7.

FIGS. 7, 8 and 9 depict the complete circuit for an exemplary antenna comprising 49 radiating lines. The slots for coupling with the radiating lines 26 are aligned at a spacing of about half a wavelength (5 mm at 30 GHz). The slots 27 in connection with the horn 12 are disposed on the exit curve (nearly a circular arc) at a spacing of likewise about half a wavelength. The length of the lines 25*a*, 25*b*, which is tailored by means of the position of the through passages 28, gives the delay necessary for the focusing and for the initial pointing of the beam toward 30° (horn in central position).

This embodiment makes it possible to limit the bulkiness of the power feed circuit 14 for linking the horn 12 to the radiating lines 17.

The invention also makes it possible to point in all the directions contained in the cone of half-angle 60° centered on the axis z by rotating the horn 12 by around ±30° about the axis z' and by rotating the antenna assembly by 360° about the axis z. This antenna structure operates in a very broad band of frequencies since the movable horn 12 makes it possible to obtain frequency-independent pointing.

The invention claimed is:

1. A flat antenna for satellite telecommunication, comprising:

a radiating board comprising at least one radiating line; and an adapter configured to modify a delay of fields emitted or received by said at least one radiating line, the adapter comprises:

a horn movable in rotation between two metallic plates;

a multilayer power feed circuit, a first layer of which is formed by at least one metallic plate comprising an array of sensors of a slot type and a last layer of which is provided with at least one coupling slot connected to said at least one radiating line;

at least one transmission line links the first layer and the last layer;

a length of said at least one transmission line is configured to introduce a delay required to focus a wave radiated by said at least one radiating line.

2. The flat antenna as claimed in claim 1, wherein the horn transmits the wave between the two metallic plates, an electric field of the wave is perpendicular to the metallic plates.

3. The flat antenna as claimed in claim 2, wherein the length of said at least one transmission line is configured to introduce an additional delay to obtain an initial fixed pointing such that a total pointing varies from 0° to 60° for a symmetric displacement of the horn of ±30°.

4. The flat antenna as claimed in claim 1, wherein the length of said at least one transmission line is configured to introduce an additional delay to obtain an initial fixed pointing such that a total pointing varies from 0° to 60° for a symmetric displacement of the horn of ±30°.

5. The flat antenna as claimed in claim 1, wherein the multilayer power feed circuit comprises five metallic circuit layers separated by four dielectric layers.

6. The flat antenna as claimed in claim 1, wherein two layers of the multilayer power feed circuit are linked by at least one metallized hole passing through a conducting layer contactlessly through a non-metallized wafer.

7. The flat antenna as claimed in claim 1, wherein the multilayer power feed circuit is assembled adhesively.

8. The flat antenna as claimed in claim 1, wherein the two metallic plates comprises the array of sensors of the slot type, the two metallic plates are fixed on a plane parallel to a plane of the radiating board.

9. The flat antenna as claimed in claim 1, wherein the radiating board comprises a plurality of radiating lines spaced apart by a half of a wavelength.

10. The flat antenna as claimed in claim 1, wherein the radiating board comprises a plurality of radiating lines comprising an alignment of radiating elements.

11. The flat antenna as claimed in claim 10, wherein the radiating elements are dipoles, patches or slots.

12. The flat antenna as claimed in claim 10, wherein each radiating line comprises a distributor with one input and a plurality of outputs corresponding to a number of the radiating elements of said each radiating line.

* * * * *